US009445188B2

(12) United States Patent
Okita

(10) Patent No.: US 9,445,188 B2
(45) Date of Patent: Sep. 13, 2016

(54) CONDENSER MICROPHONE

(71) Applicant: KABUSHIKI KAISHA AUDIO-TECHNICA, Machida-shi, Tokyo (JP)

(72) Inventor: Shioto Okita, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 105 days.

(21) Appl. No.: 14/516,054

(22) Filed: Oct. 16, 2014

(65) Prior Publication Data

US 2015/0110306 A1 Apr. 23, 2015

(30) Foreign Application Priority Data

Oct. 21, 2013 (JP) ..... 2013-218191
Jul. 18, 2014 (JP) ..... 2014-147901

(51) Int. Cl.

| | |
|---|---|
| ***H04R 25/00*** | (2006.01) |
| ***H04R 3/00*** | (2006.01) |
| ***H04R 19/04*** | (2006.01) |
| *H04R 19/01* | (2006.01) |

(52) U.S. Cl.

CPC ..... *H04R 3/00* (2013.01); *H04R 19/04* (2013.01); *H04R 19/016* (2013.01)

(58) Field of Classification Search

USPC ..... 381/174

See application file for complete search history.

(56) References Cited

U.S. PATENT DOCUMENTS

| | | | | |
|---|---|---|---|---|
| 7,580,735 | B2 * | 8/2009 | Akino | 455/575.1 |
| 2011/0085683 | A1 * | 4/2011 | Ejaz | H04R 19/04 381/174 |

FOREIGN PATENT DOCUMENTS

| | | | |
|---|---|---|---|
| JP | S62-103390 | A | 7/1987 |
| JP | 2006-352622 | A | 12/2006 |

* cited by examiner

*Primary Examiner* — Amir Etesam
(74) *Attorney, Agent, or Firm* — Manabu Kanesaka

(57) ABSTRACT

A condenser microphone that provides a balanced output of audio signals from initial steps of a diaphragm and a fixed electrode is provided. The condenser microphone includes: a condenser microphone unit including a diaphragm being arranged opposite a fixed electrode; a first impedance converter being connected to the fixed electrode of the condenser microphone unit and outputting a first electric signal generated in the fixed electrode; and a second impedance converter being connected to the diaphragm of the condenser microphone unit and outputting a second electric signal generated in the diaphragm. By this structure, balanced outputs of the audio signals having phases reverse to each other are provided by the first and second impedance converters immediately after the condenser microphone unit.

10 Claims, 7 Drawing Sheets

CONDENSER MICROPHONE

RELATED APPLICATIONS

The present application is based on, and claims priority from, Japanese Applications No. JP2013-218191 filed Oct. 21, 2013 and No. 2014-147901 filed Jul. 18, 2014, the disclosure of which is hereby incorporated by reference herein in its entirety.

BACKGROUND OF THE INVENTION

1. Field of the Invention

The present invention relates to a condenser microphone that provides a balanced output of an audio signal by a condenser microphone unit configured by a diaphragm and a fixed electrode.

2. Description of the Related Art

In a condenser microphone, an audio signal is generated on the basis of a change in capacitance between a diaphragm and a fixed electrode opposite to each other.

That is, a condenser microphone unit obtained by arranging the diaphragm opposite the fixed electrode is configured to extract the audio signal using an impedance converter by a field effect transistor (FET), for example, because output impedance is very high, when the capacitance is about several tens of picofarad (pF).

When the condenser microphone unit is connected to the impedance converter, a circuit structure in which one of the fixed electrode and the diaphragm is connected to a reference potential point (ground line) of a circuit and the other is connected to an input terminal of the impedance converter, that is, a gate terminal of the FET is adopted.

In addition, the impedance converter is generally configured by a source follower circuit that obtains an audio output from a source terminal of the FET.

In addition, this kind of condenser microphone including the impedance converter is configured such that the audio signal is supplied to an external apparatus such as a mixer circuit or a microphone amplifier through a balanced shield cable and an operation current is supplied from a known phantom feeding device included at the side of the external apparatus to the side of the condenser microphone through the balanced shield cable.

That is, the condenser microphone using the phantom feeding device adopts measures to transmit a balanced output obtained by configuring the audio signals in a reverse phase relation through the balanced shield cable to minimize an influence of external noise.

FIG. 6 illustrates an example according to the related art using a phase inversion circuit as a unit for providing a balanced output of audio signals from a condenser microphone.

A reference numeral U1 illustrated in FIG. 6 shows the condenser microphone unit. In this example, a condenser microphone unit U1 of an electret type is configured to include an electret dielectric film in any one of a diaphragm and a fixed electrode. In addition, for example, the diaphragm configuring the condenser microphone unit U1 is connected to a reference potential point of a circuit and the fixed electrode is connected to an impedance converter 11.

Current of an audio signal generated by the impedance converter 11 is amplified in a buffer circuit 12 including an emitter follower circuit and is supplied to an inverter circuit 13.

In addition, balanced outputs of a non-inversion audio output from the buffer circuit 12 and an inversion audio output through the inverter circuit 13 are provided to a hot-side terminal Out (+) and a cold-side terminal Out (−) through a buffer circuit 14 receiving an operation current from a phantom feeding device, respectively, and are transmitted to an external apparatus such as a mixer circuit, for example, through a balanced shield cable (not shown) in which a ground line GND is connected to a shield.

In addition, a direct-current operation current supplied from the phantom feeding device (not shown) of the side of the external apparatus is received in the buffer circuit 14 through the balanced shield cables of the hot side and the cold side and the direct-current operation current is supplied to a constant voltage power supply circuit 15. In addition, an output voltage from the constant voltage power supply circuit 15 is used as an operation power supply of the individual circuits shown by the reference numerals 11 to 14.

The condenser microphone that provides a balanced output of the audio signals using the inverter circuit (phase inversion circuit) 13 illustrated in FIG. 6 is disclosed in JP 62-103390 U.

FIG. 7 illustrates an example according to the related art using a transformer as a unit for providing a balanced output of audio signals from a condenser microphone.

Reference numerals U1, 11, and 12 illustrated in FIG. 7 show elements executing the same functions as the functions of the individual units shown by the same reference numerals as the reference numerals illustrated in FIG. 6 and a detailed description thereof is omitted.

In a structure illustrated in FIG. 7, a transformer T1 with a center tap provided in a secondary winding is adopted and an audio output from the buffer circuit 12 is supplied to a primary winding of the transformer T1. In addition, balanced outputs of audio signals that are generated in both ends of the secondary winding of the transformer T1 and are in a reverse phase relation to each other are provided to a hot-side terminal Out (+) and a cold-side terminal Out (−) and are transmitted to an external apparatus such as a mixer circuit through a balanced shield cable (not shown) including a ground line GNU.

In addition, a direct-current operation current supplied from a phantom feeding device (not shown) of the side of the external apparatus is received in the secondary winding of the transformer T1 through the balanced shield cable and is supplied to the constant voltage power supply circuit 15 through the center tap of the secondary winding. In addition, an output voltage from the constant voltage power supply circuit 15 is used as an operation power supply of the individual circuits shown by the reference numerals 11 and 12.

A condenser microphone that provides a balanced output of the audio signals using the transformer T1 illustrated in FIG. 7 is disclosed in JP 2006-352622 A.

According to the condenser microphone disclosed in JP 62-103390 U and illustrated in FIG. 6, all of the condenser microphone unit U1, the impedance converter 11, the buffer circuit 12, the inverter circuit 13, and the buffer circuit 14 configure an unbalanced signal transmission line using the other side as a ground line.

Therefore, in the individual circuits shown by the reference numerals U1 and 11 to 14 illustrated in FIG. 6, when, for example, high frequency noise or the like is overlapped, the noise cannot be removed and particular measures are necessary to suppress external noise.

In addition, according to the structure illustrated in FIG. 6, because the inversion audio output is generated through the inverter circuit 13, unbalance of signals by a difference of signal transmission systems occurs between the inversion audio output and a non-inversion audio output not transmitted through the inverter circuit 13, which results in causing a quality of the audio signals to be deteriorated.

On the other hand, according to the condenser microphone disclosed in JP 2006-352622 A and illustrated in FIG. 7, the individual circuits including the condenser microphone unit U1, the impedance converter 11, the buffer circuit 12, and the primary winding of the transformer T1 configure an unbalanced signal transmission line using the other side as the ground line. For this reason, the condenser microphone is vulnerable to the external noise, similar to the example illustrated in FIG. 6.

In addition, according to the structure illustrated in FIG. 7, entire performance of the microphone is limited by a unique frequency characteristic or a distortion characteristic of the transformer T1, and the transformer T1 increases a cost.

SUMMARY OF THE INVENTION

The present invention has been made in view of the above-described problems in the condenser microphone according to the related art and the present invention provides a condenser microphone that provides a balanced output of audio signals having phases reverse to each other from initial steps of a diaphragm and a fixed electrode configuring a condenser microphone unit.

That is, an object of the present invention is to provide a condenser microphone that provides balance-transmits of audio signals having phases reverse to each other immediately after a condenser microphone unit, on the basis of the technical point of view described above, thereby effectively cancelling external noise and sufficiently securing a quality of the audio signal.

A condenser microphone according to the present invention, which was made in order to achieve the above object, includes: a condenser microphone unit including a diaphragm being arranged opposite a fixed electrode; a first impedance converter being connected to the fixed electrode of the condenser microphone unit and outputting a first electric signal generated in the fixed electrode; and a second impedance converter being connected to the diaphragm of the condenser microphone unit and outputting a second electric signal generated in the diaphragm, wherein balanced outputs of the first electric signal and the second electric signal are provided as audio signals by the condenser microphone unit.

In this case, in a preferable form, the condenser microphone unit to be used is a condenser microphone unit of an electret type including an electret dielectric film in any one of the fixed electrode and the diaphragm.

Further, it is desirable that the first impedance converter includes a first FET and configures a source follower circuit in which a gate terminal of the first FET is connected to the fixed electrode and the first electric signal is output from a source terminal and the second impedance converter includes a second FET and configures a source follower circuit in which a gate terminal of the second FET is connected to the diaphragm and the second electric signal is output from a source terminal.

In addition, the first electric signal output from the first impedance converter and the second electric signal output from the second impedance converter are transmitted to an external apparatus through balanced shield cables.

Further, in a preferable form, in a configuration to be adopted, buffer circuits including a hot-side terminal and a cold-side terminal are connected to rear steps of the first impedance converter and the second impedance converter, respectively, and the first electric signal and the second electric signal are output to the hot-side terminal and the cold-side terminal, respectively.

According to the condenser microphone of to the present invention, the signal of the side of the fixed electrode is obtained as the first electric signal by the first impedance converter and the signal of the side of the diaphragm is obtained as the second electric signal by the second impedance converter and balanced outputs of the first and second electric signals are provided as positive and negative audio signals (having phases reverse to each other).

That is, balanced outputs of the audio signals having the phases reverse to each other are provided by the individual impedance converters immediately after the condenser microphone unit and current of the balanced output of audio signals are amplified according to necessity and are transmitted to an external apparatus through balanced shield cables.

Therefore, even though external noise is overlapped in a signal transmission line including the impedance converter, an external noise component can be cancelled in a step of obtaining the audio signals from the first and second electric signals, which results in contributing to improving S/N of the condenser microphone.

In addition, because the balanced output of first and second electric signals can be provided through signal transmission lines by the same circuit structure, a condenser microphone in which a quality of audio signals is sufficiently secured can be provided.

DESCRIPTION OF THE PREFERRED EMBODIMENTS

Figure 1A:
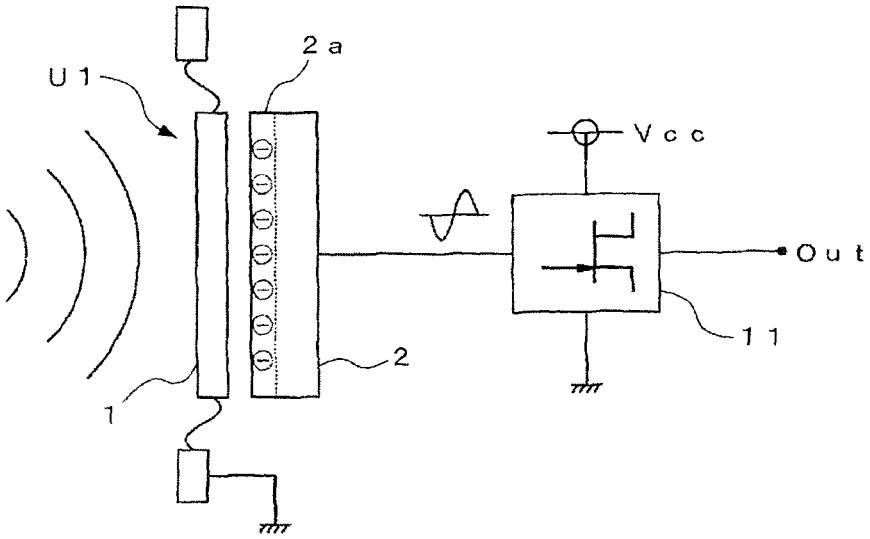
FIG. 1A is a schematic diagram illustrating an example of extracting an audio signal from a fixed electrode.

A condenser microphone according to the present invention will be described on the basis of embodiments illustrated in the drawings.

Figure 1B:
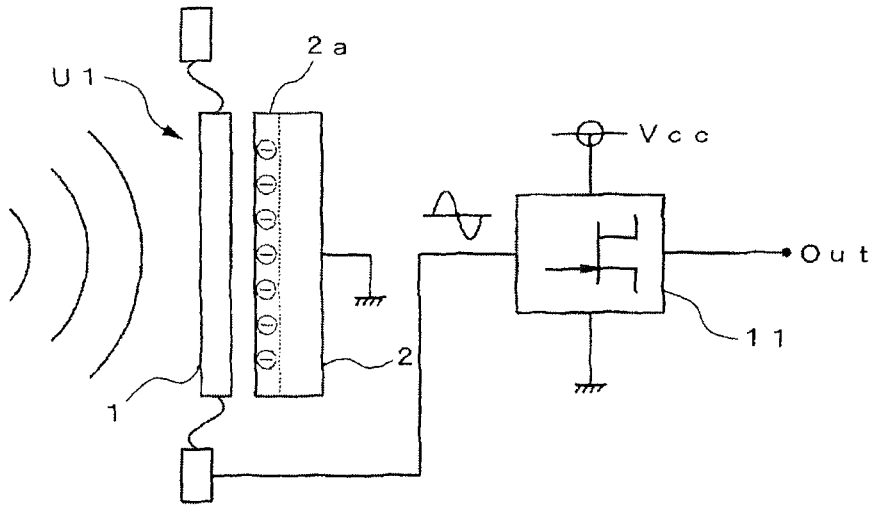
FIG. 1B is a schematic diagram illustrating an example of extracting an audio signal from a diaphragm.

As described above, in a condenser microphone unit, a diaphragm is arranged to opposite a fixed electrode and a condenser is formed between the diaphragm and the fixed electrode. FIGS. 1A and 1B illustrate an example of a condenser microphone unit U1 of an electret type including an electret dielectric film 2*a* in which negative charges are charged, at the side of a fixed electrode 2 facing a diaphragm 1.

In the example illustrated in FIGS. 1A and 1B, a charge amount Q by the electret dielectric film 2*a* is constant and a change in capacitance C of the condenser microphone unit U1 receiving a sound pressure changes a voltage according to a relation of Q=C×V (V is a voltage between both poles of a condenser).

In addition, in the condenser microphone unit U1 illustrated in FIGS. 1A and 1B, when a positive sound pressure is received in the diaphragm 1, a positive voltage signal is generated at the side of the diaphragm 1 and a negative voltage signal is generated at the side of the fixed electrode 2.

Therefore, as illustrated in FIG. 1A, in a structure in which the diaphragm 1 is connected to a reference potential point (ground line) and an electric signal (audio signal) is obtained from the fixed electrode 2 through an impedance converter 11, the audio signal is output to an output terminal Out of the impedance converter 11, on the basis of a negative voltage signal generated at the side of the fixed electrode 2.

In addition, as illustrated in FIG. 1B, in a structure in which the fixed electrode 2 is connected to the reference potential point (ground line) and an electric signal (audio signal) is obtained from the diaphragm 1 through the impedance converter 11, the audio signal is output to the output terminal Out of the impedance converter 11, on the basis of a positive voltage signal generated at the side of the diaphragm 1.

That is, voltage signals of which phases become reverse to each other according to displacement of the diaphragm 1 are simultaneously generated in the diaphragm 1 and the fixed electrode 2 of the condenser microphone unit U1.

Figure 2:
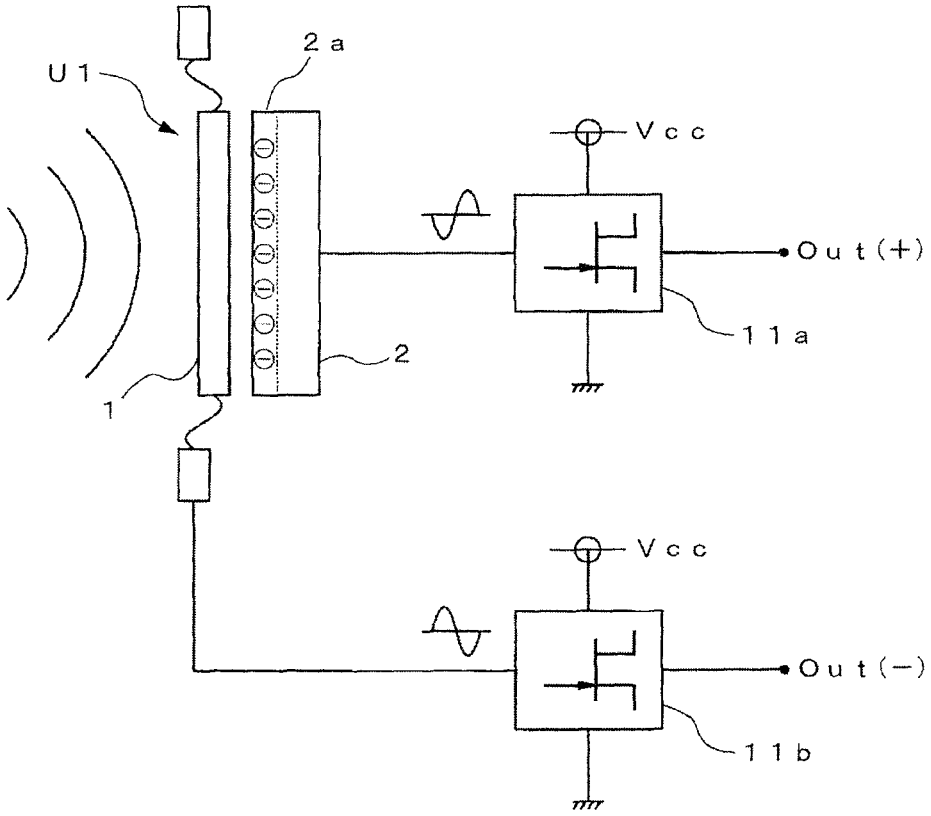
FIG. 2 is a schematic diagram illustrating a condenser microphone according to the present invention that extracts a balanced output signal from each of a fixed electrode and a diaphragm.

Therefore, as illustrated in a schematic diagram of FIG. 2, in the present invention, it is assumed that a first impedance converter 11*a* and a second impedance converter 11*b* having input impedances of high values are connected to the fixed electrode 2 and the diaphragm 1, respectively, and balanced outputs of the voltage signals of the reverse phases generated on the basis of the displacement of the diaphragm 1 are provided from the first and second impedance converters 11*a* and 11*b*, respectively.

Figure 3:
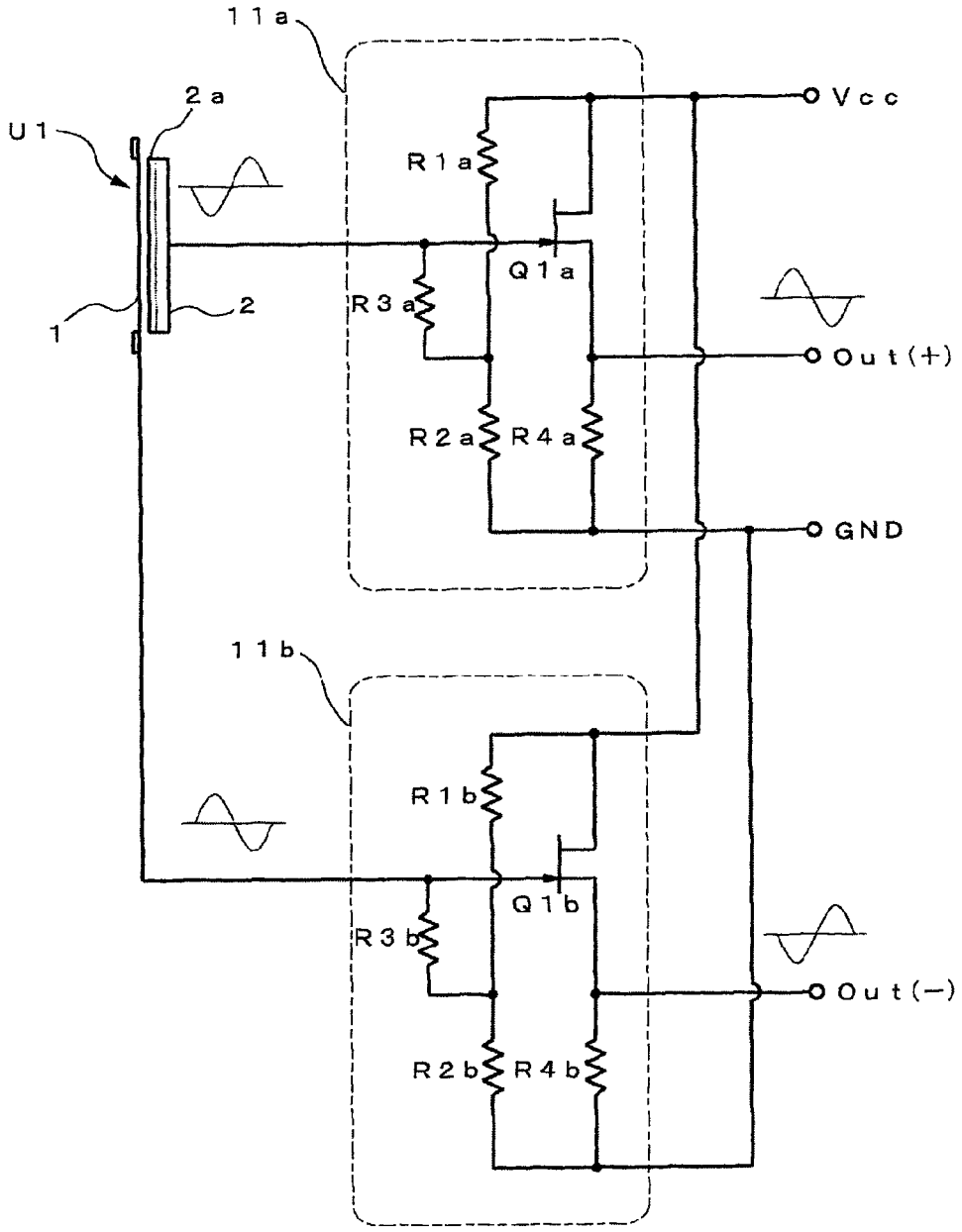
FIG. 3 is a circuit structural diagram illustrating a first form of a condenser microphone according to the present invention.

FIG. 3 is a circuit structural diagram specifically illustrating a main portion of the condenser microphone configured according to the technical point of view described above, particularly, the condenser microphone unit U1 and the impedance converter.

That is, the condenser microphone unit U1 is configured in a state in which the diaphragm 1 is opposite the fixed electrode 2, as described above. In the embodiment, the known electret type condenser microphone unit U1 including the electret dielectric film 2*a* in the fixed electrode 2 is configured.

In addition, the first impedance converter 11*a* is connected to the fixed electrode 2 and the second impedance converter 11*b* is connected to the diaphragm 1. By this structure, the voltage signals of the phases reverse to each other that are generated in the diaphragm 1 and the fixed electrode 2 on the basis of the displacement of the diaphragm 1 are extracted.

An FET of an n channel type shown by a reference numeral Q1*a* is mounted to the first impedance converter 11*a* and the fixed electrode 2 is connected to a gate electrode of the FET Q1*a*.

In addition, voltage division resistors R1*a* and R2*a* are connected between a direct-current power supply Vcc and a ground line GND, a bias supply resistor R3*a* is connected between a connection point thereof and the gate electrode, and a predetermined bias voltage is supplied to the gate electrode.

In addition, the direct-current power supply Vcc is supplied to a drain electrode of the FET Q1*a*, a resistance element (source follower resistor) R4*a* is connected between a source electrode of the FET Q1*a* and the ground line GND, and the source electrode becomes an output terminal Out (+). That is, the impedance converter 11*a* configures a source follower circuit.

In addition, the second impedance converter 11*b* is configured by the same circuit as the circuit of the first impedance converter 11*a*. In each corresponding element, "a" shown at the end of the reference numeral is replaced by "b". Therefore, a detailed description of the second impedance converter 11*b* is omitted.

In addition, a source electrode of an FET Q1*b* mounted to the second impedance converter 11*b* becomes an output terminal Out (−).

According to a structure illustrated in FIG. 3, balanced outputs of the voltage signals that are generated in the fixed electrode 2 and the diaphragm 1 and have the phases reverse to each other are provided to the output terminal Out (+) of the first impedance converter 11*a* and the output terminal Out (−) of the second impedance converter 11*b*, respectively. Therefore, a potential difference (difference) of balanced outputs of the output terminal Out (+) and the output terminal Out (−), respectively, can be used as an audio signal of the condenser microphone.

Figure 4:
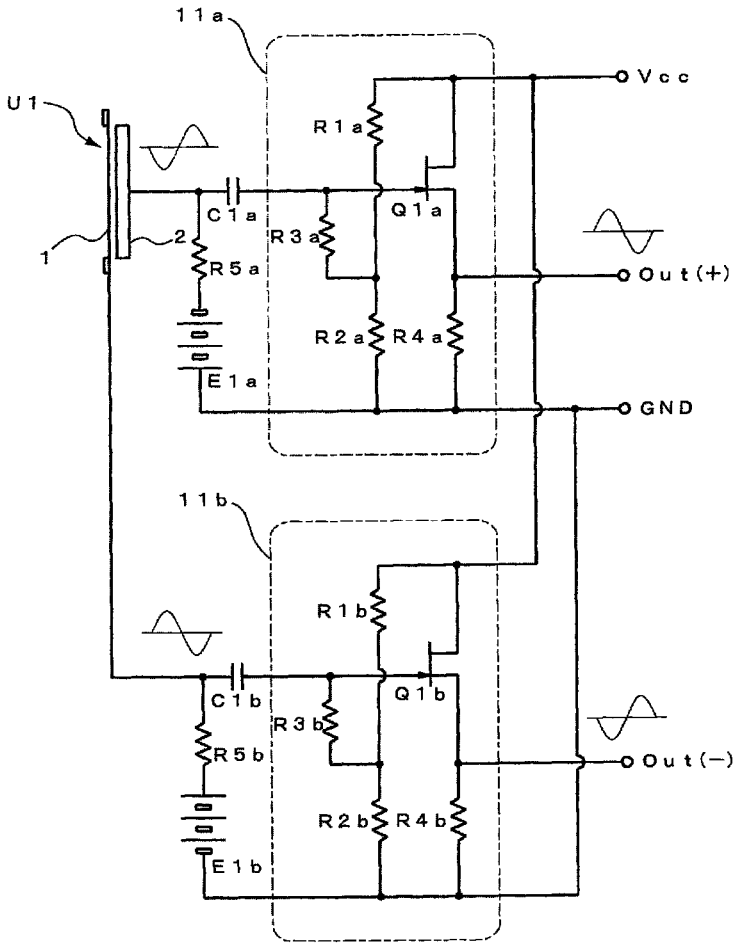
FIG. 4 is a circuit structural diagram illustrating a second form.

A structure illustrated in FIG. 4 is another example of the condenser microphone unit U1 and the impedance converter.

The structure illustrated in FIG. 4 is a structure in which a polarization power supply is used, instead of the electret dielectric film 2*a* illustrated in FIG. 3, and a negative potential is supplied from a polarization power supply E1*a* to the fixed electrode 2 through a high resistance element R5*a*, as illustrated in FIG. 4.

In addition, a direct-current cut condenser C1*a* is inserted between the fixed electrode 2 and the FET Q1*a* of the impedance converter 11*a* to prevent a voltage from being applied from the polarization power supply E1*a* to the FET Q1*a*.

On the other hand, a positive potential is supplied from the polarization power supply E1*b* to the diaphragm 1 through a high resistance element R5*b*.

In addition, a direct-current cut condenser C1*b* is inserted between the diaphragm 1 and the FET Q1*b* of the impedance converter 11*b* to prevent a voltage from being applied from the polarization power supply E1*b* from the FET Q1*b*.

The first and second impedance converters 11*a* and 11*b* illustrated in FIG. 4 have the same structure as the structure illustrated in FIG. 3. Therefore, a detailed description thereof is omitted.

Even in the structure illustrated in FIG. 4, the same function as the function in the example illustrated in FIG. 3 is executed and balanced outputs of the voltage signals that are generated in the fixed electrode 2 and the diaphragm 1 and have the phases reverse to each other are provided from the output terminal Out (+) of the first impedance converter 11*a* and the output terminal Out (−) of the second impedance converter 11*b*, respectively.

In the structure illustrated in FIG. 4, the voltage is applied from the negative and positive polarization power supplies E1*a* and E1*b* to the fixed electrode 2 and the diaphragm 1, respectively, and a balance is maintained in a circuit from an initial step of the condenser microphone unit U1.

However, in the structure illustrated in FIG. 4, for example, even though any one of the polarization power supply E1*b* from which the voltage is applied to the diaphragm 1 and the peripheral circuits (R5*b* and C1*b*) thereof or the polarization power supply E1*a* from which the voltage is applied to the fixed electrode 2 and the peripheral circuits (R5*a* and C1*a*) thereof is removed, a predetermined polarization voltage can be applied between the diaphragm 1 and the fixed electrode 2. Therefore, a function and an effect thereof are the same.

Figure 5:
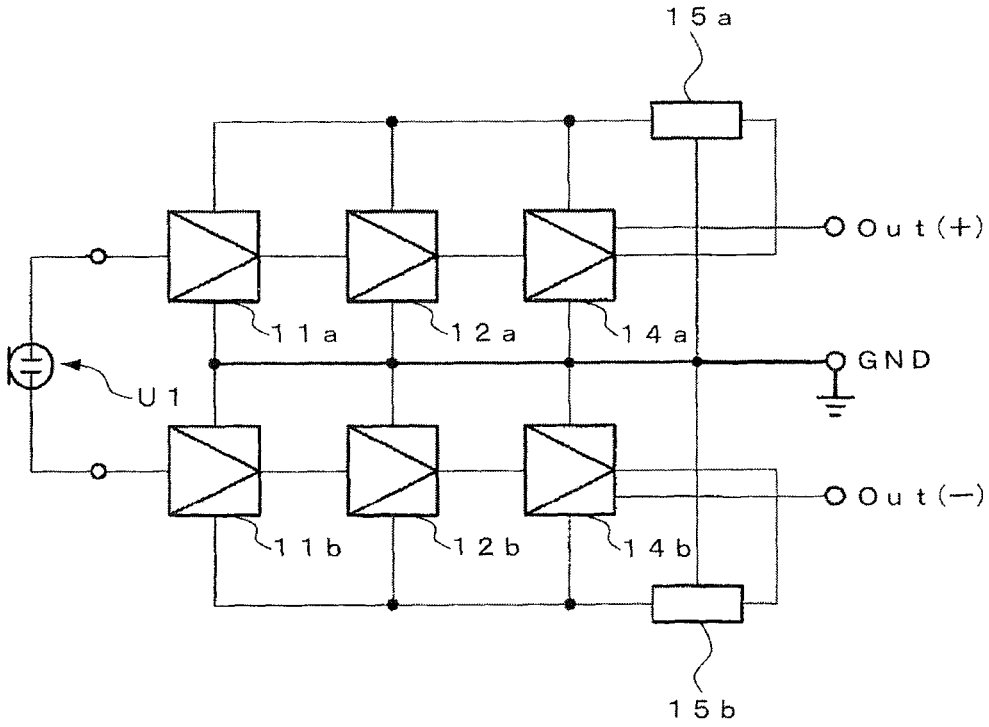
FIG. 5 is a block diagram illustrating an entire structure of a condenser microphone including the circuit structures illustrated in FIGS. 3 and 4.
Figure 6:
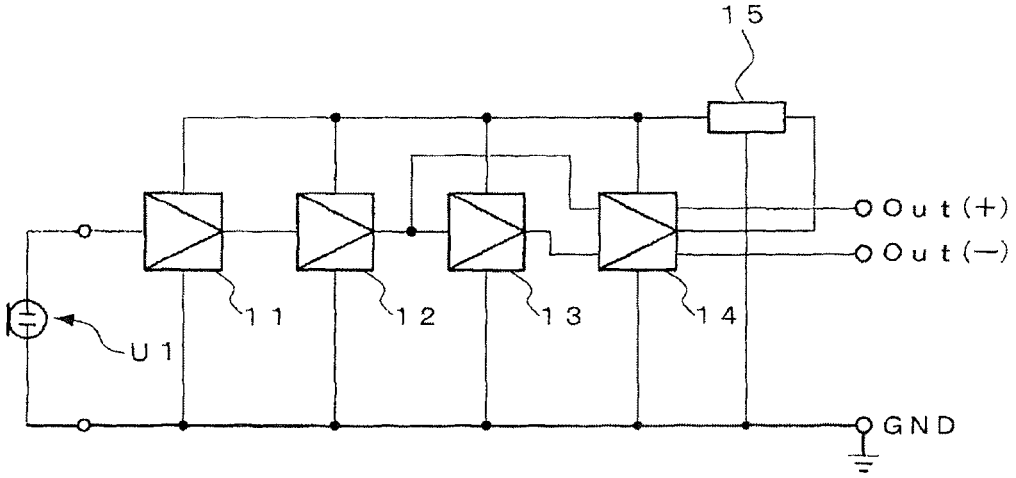
Fig. 6 Prior Art
FIG. 6 is a block diagram illustrating an example of providing a balanced output of an audio signal in a condenser microphone according to the related art.
Figure 7:
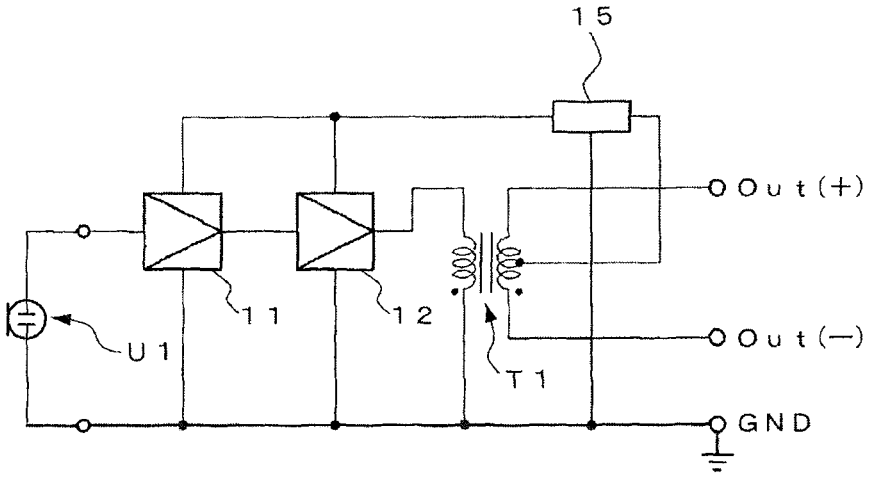
Fig. 7 Prior Art
FIG. 7 is a block diagram illustrating another example of providing a balanced output of an audio signal in the related art.

FIG. 5 illustrates a structure in which buffer circuits 12*a* and 12*b* and buffer circuits 14*a* and 14*b* receiving an operation current from an external phantom feeding device are connected to rear steps of the first impedance converter 11*a* and the second impedance converter 11*b* illustrated in FIGS. 3 and 4, respectively.

The buffer circuits 12*a* and 12*b* amplifies current of balanced output signals from the first and second impedance converters 11*a* and 11*b*, respectively, and the buffer circuits 12*a* and 12*b* are arranged according to necessity.

In addition, a hot-side terminal Out (+) and a cold-side terminal Out (−) are provided in the buffer circuits 14*a* and 14*b* of final steps and a balanced output of the audio signal of the condenser microphone is provided to each terminal and is transmitted to an external apparatus such as a mixer circuit through a balanced shield cable (not shown) in which a ground line GND is connected to a shield.

In addition, resistance elements (not shown) are provided between the hot-side terminal Out (+) of the buffer circuit 14*a* and a constant voltage power supply circuit 15*a* and between the cold-side terminal Out (−) of the buffer circuit 14*b* and a constant voltage power supply circuit 15*b*, respectively, and an operation current transmitted from the phantom feeding device provided in the external apparatus such as the mixer circuit is supplied to the individual constant voltage power supply circuits 15*a* and 15*b* through the individual resistance elements.

In addition, an output voltage from one constant voltage power supply circuit 15*a* is used as an operation power supply Vcc of the individual circuits shown by the reference numerals 11*a* to 14*a* and an output voltage from the other constant voltage power supply circuit 15*b* is used as an operation power supply Vcc of the individual circuits shown by the reference numerals 11*b* to 14*b*.

As apparent from the above description, according to the embodiment, balanced outputs of the electric signals based on the change of the capacitance between the fixed electrode 2 and the diaphragm 1 configuring the condenser microphone unit are provided as the positive and negative output signals by the first and second impedance converters 11*a* and 11*b*, respectively.

That is, because balanced outputs of the positive and negative output signals are provided including the impedance converters of the initial steps, signal transmission lines including the buffer circuits 12*a* and 12*b* connected to the rear steps of the impedance converters or the buffer circuits 14*a* and 14*b* receiving the operation current from the phantom feeding device can be configured as a balanced transmission line of the same circuit.

Thereby, a condenser microphone in which sufficient measures against external noise can be taken and a quality of an audio signal is sufficiently secured can be provided, and the operations and effects described as the advantageous effects of the invention can be obtained.

What is claimed is:

1. A condenser microphone comprising:

a condenser microphone unit including a fixed electrode, and a diaphragm facing the fixed electrode to form a space therebetween;

a first resistance element connected to the fixed electrode;

a first polarization power supply connected to the first resistance element at one end thereof, and supplying a negative or positive potential to the fixed electrode through the first resistance element;

a first impedance converter connected to the fixed electrode of the condenser microphone unit and outputting a first electric signal generated in the fixed electrode;

a first direct-current cut condenser connected between the fixed electrode and the first impedance converter, the negative or positive potential being supplied in between the fixed electrode and the first direct-current cut condenser;

a second resistance element connected to the diaphragm;

a second polarization power supply connected to the second resistance element at one end thereof, and supplying a positive or negative potential to the diaphragm through the second resistance element;

a second impedance converter connected to the diaphragm of the condenser microphone unit and outputting a second electric signal generated in the diaphragm; and a second direct-current cut condenser connected between the diaphragm and the second impedance converter, the positive or negative potential being supplied in between the diaphragm and the second direct-current cut condenser, wherein balanced outputs of the first electric signal and the second electric signal are provided as audio signals by the condenser microphone unit, and another end of the first polarization power supply and another end of the second polarization power supply are connected to ground.

2. The condenser microphone according to claim 1, wherein the first electric signal and the second electric signal have phases reverse to each other.

3. The condenser microphone according to claim 1, wherein the first impedance converter includes a first FET and forms a source follower circuit in which a gate terminal of the first FET is connected to the fixed electrode and the first electric signal is output from a source terminal and the second impedance converter includes a second FET and forms a source follower circuit in which a gate terminal of the second FET is connected to the diaphragm and the second electric signal is output from a source terminal.

4. The condenser microphone according to claim 2, wherein the first impedance converter includes a first FET and forms a source follower circuit in which a gate terminal of the first FET is connected to the fixed electrode and the first electric signal is output from a source terminal and the second impedance converter includes a second FET and forms a source follower circuit in which a gate terminal of the second FET is connected to the diaphragm and the second electric signal is output from a source terminal.

5. The condenser microphone according to claim 1, wherein the first electric signal output from the first impedance converter and the second electric signal output from the second impedance converter are transmitted to an external apparatus through balanced shield cables.

6. The condenser microphone according to claim 2, wherein the first electric signal output from the first impedance converter and the second electric signal output from the second impedance converter are transmitted to an external apparatus through balanced shield cables.

7. The condenser microphone according to claim 3, wherein the first electric signal output from the first impedance converter and the second electric signal output from the second impedance converter are transmitted to an external apparatus through balanced shield cables.

8. The condenser microphone according to claim 4, wherein the first electric signal output from the first impedance converter and the second electric signal output from the second impedance converter are transmitted to an external apparatus through balanced shield cables.

9. The condenser microphone according to claim 1, wherein buffer circuits including a hot-side terminal and a cold-side terminal are connected to rear steps of the first impedance converter and the second impedance converter, respectively, and the first electric signal and the second electric signal are output to the hot-side terminal and the cold-side terminal, respectively.

10. The condenser microphone according to claim 1, wherein the first impedance converter includes a first FET, and the first direct-current cut condenser is connected between the first FET and the fixed electrode to prevent a voltage from being applied from the first polarization power supply to the first FET; and the second impedance converter includes a second FET, and the second direct-current cut condenser is connected between the second FET and the diaphragm to prevent a voltage from being applied from the second polarization power supply to the second FET.

* * * * *